United States Patent [19]

Pereira et al.

[11] Patent Number: 4,682,689

[45] Date of Patent: Jul. 28, 1987

[54] DUAL COMPARTMENT CONTAINER

[75] Inventors: Joseph J. Pereira, West Redding, Conn.; Malcolm E. Taylor, Pelham; Bernard Sawaf, Nashua, both of N.H.

[73] Assignee: Clairol Incorporated, New York, N.Y.

[21] Appl. No.: 879,651

[22] Filed: Jun. 27, 1986

[51] Int. Cl.[4] ..... B65D 25/08; B65D 1/04

[52] U.S. Cl. ..... 206/222; 206/219; 215/DIG. 8

[58] Field of Search ..... 206/219, 220, 221, 222, 206/569, 568; 366/130; 215/DIG. 8

[56] References Cited

U.S. PATENT DOCUMENTS

| | | | |
|---|---|---|---|
| 3,349,966 | 10/1967 | Schwartzman | 206/222 |
| 3,924,741 | 12/1975 | Kachur et al. | 366/130 |
| 4,024,952 | 5/1977 | Leitz | 206/221 |
| 4,247,001 | 1/1981 | Wiegner | 215/DIG. 8 |
| 4,387,998 | 6/1983 | Szigeti | 366/130 |
| 4,408,690 | 10/1983 | Ferraro | 206/219 |
| 4,465,183 | 8/1984 | Saito et al. | 215/DIG. 8 |
| 4,591,050 | 5/1986 | Finke et al. | 206/222 |
| 4,615,437 | 10/1986 | Finke et al. | 206/222 |

*Primary Examiner*—Stephen P. Garbe
*Assistant Examiner*—Brenda J. Ehrhardt
*Attorney, Agent, or Firm*—G. P. Katona

[57] ABSTRACT

A dual-compartment container for use with two substances which must be separated prior to use and which may be combined by the single step of removing the cap from the container. A top container containing one substance is sealed along its bottom end by a membrane and is rotatably seated within a bottom container containing another substance. A container cap seals the top container prior to use and is threaded onto the bottom container. The cap is provided with a ratchet means which causes common rotation of the cap and the top container while the cap is being unthreaded from the bottom container. An annular knife member is interposed between the two containers and keyed to the top container for common rotation therewith as the cap is removed. Cam means are provided to translate rotary motion of the knife member relative to the bottom container into longitudinal motion of the knife member relative to the top container in order to pierce the sealing membrane.

10 Claims, 8 Drawing Figures

DUAL COMPARTMENT CONTAINER

BACKGROUND OF THE INVENTION

1. Field of the Invention

The invention relates generally to containers having a plurality of component containers or compartments for containing a variety of dissimilar substances. More particularly, the invention relates to a dual compartment container for containing and isolating two separate substances and facilitating their mixture just before use by a consumer.

2. Description of the Prior Art

Dual compartment containers have been used in the past to ship and store products having component substances which must be kept separated until immediately prior to use. The separation may be necessitated for a variety of reasons. For example, separation may be necessary to extend the shelf life of a product because the component materials begin to degrade a short time after they have been mixed. Also, separation is necessary for products having component materials which create unacceptable or dangerous pressure within the container after they are mixed. In some situations, dual compartment containers are used merely to enable the mixing of the component materials within a common compartment and dispensing same from a common spout without the necessity of manually pouring the contents of one container into another container prior to use. This avoids spillage which, in addition to being unpleasant for consumers, may create a safety hazard if caustic substances are to be mixed. Spillage may also unacceptably change the ratio of the component materials required for producing a satisfactory product.

One example of a dual compartment common spout container is shown in U.S. Pat. No. 4,465,183. The dual oompartment container shown in this patent is intended for a hair ooloring product where each compartment contains a different liquid. Prior to use, a consumer would remove a breakable partition spacing the containers axially and screw the containers together thereby activating an internal knife member molded into one of the containers to cut foil membranes used to seal each container and keep their respective contents separated. There are several disadvantages associated with this container. For example, the knife member is integral with the top container and, therefore, requires fairly complex and costly molding operations. The lateral motion of the knife member relative to the membrane during the cutting action creates the possibility of tearing the membrane and, therefore, interfering with the mixing of the contents, especially if the component substances are somewhat viscous liquids. This container utilizes a separate piece (the breakable partition) which performs no other function than to maintain the containers separated during shipment and prior to use, thus also adding to the cost. Additionally, the container shown in this patent requires a three-step operation prior to use: (1) the user must remove the partition, (2) screw the containers together, and then (3) remove the cap sealing the spout. For customer convenience, a fewer number of operations would be preferable. This container requires two separate membrane seals, one for each separate compartment. One of these seals is an extra part, again adding to the cost of the overall container. Furthermore, the intermediate member which is used to hold and screw the containers together as they are being threaded toward each other is also an extra piece which adds to the complexity and cost of the device. The container disclosed in this patent also requires that the membranes sealing each of the containers be completely cut, thus possibly enabling the membranes to clog the spout of the container during use.

Another example of a dual compartment container is shown in U.S. Pat. No. 4,247,001. One of the compartments in this container has a flexible bottom wall and includes a cutting frame within its interior. Pressing the bottom wall in a given direction causes the cutting frame to press against a sealing membrane to cut it with a piercing action. One deficiency of this type of container is that the bottom wall must be protected during shipment to avoid premature piercing of the membrane. Another deficiency is that the container requires a separate cap or seal for the spout. This is an extra part adding to the cost and complexity of the container. Additionally, the operation of the container requires three steps: (1) the protective feature preventing premature motion of the flexible wall must be removed, (2) the flexible wall must be depressed to cut the membrane and (3) then the spout must be opened. In addition to the foregoing disadvantages, the containers shown in U.S. Pat. No. 4,247,001 are also not suitable for mixing viscous fluids. The presence of the knife frame within the container creates an impediment to material flow which interferes with complete mixing of such substances.

To overcome the disadvantages of the prior art, it is an object of this invention to provide a dual compartment container wherein only a single operation is required by the user to open the container and prepare the contents for use.

It is a further object of this invention to provide a dual compartment container for containing two separate substances wherein only one of the containers is sealed with a membrane.

It is still another object of this invention to provide a dual compartment container having an annular internal knife member for piercing a sealing membrane.

It is still another object of this invention to provide a dual compartment container having an annular internal knife member for piercing a sealing membrane without any relative lateral motion between the knife and the membrane.

It is yet another object of this invention to provide a dual compartment container having an annular internal knife member for piercing a sealing membrane as the cap of the container is being removed.

It is also a object of this invention to provide a dual compartment container that may perform its intended shipping, separating and mixing functions without the need for auxiliary spacing pieces to maintain separation of component parts prior to use.

SUMMARY OF THE INVENTION

These and other objects of the invention are produced by the preferred embodiment disclosed herein comprising a first container having a cylindrical, threaded neck portion; a second container rotatably and sealingly secured within said neck portion, the bottom end of said second container by a membrane; a cap for threadably engaging said neck portion; means interposed between said cap and said second container for enabling common rotation in a predetermined direction; a substantially annular knife member interposed between said first and second containers for piercing said membrane upon rotation of said cap in said predetermined direction and consequent rotation of said second container relative to said first container; means for translating rotary motion of said cap to longitudinal motion of said knife member.

FIGS. *7a* and *b* are cross-sectional views of the dual compartment container showing the change in position of the internal knife member before the sealing membrane is pierced (FIG. *7a*) and after (FIG. *7b*).

DESCRIPTION OF THE PREFERRED EMBODIMENT

Figure 1:
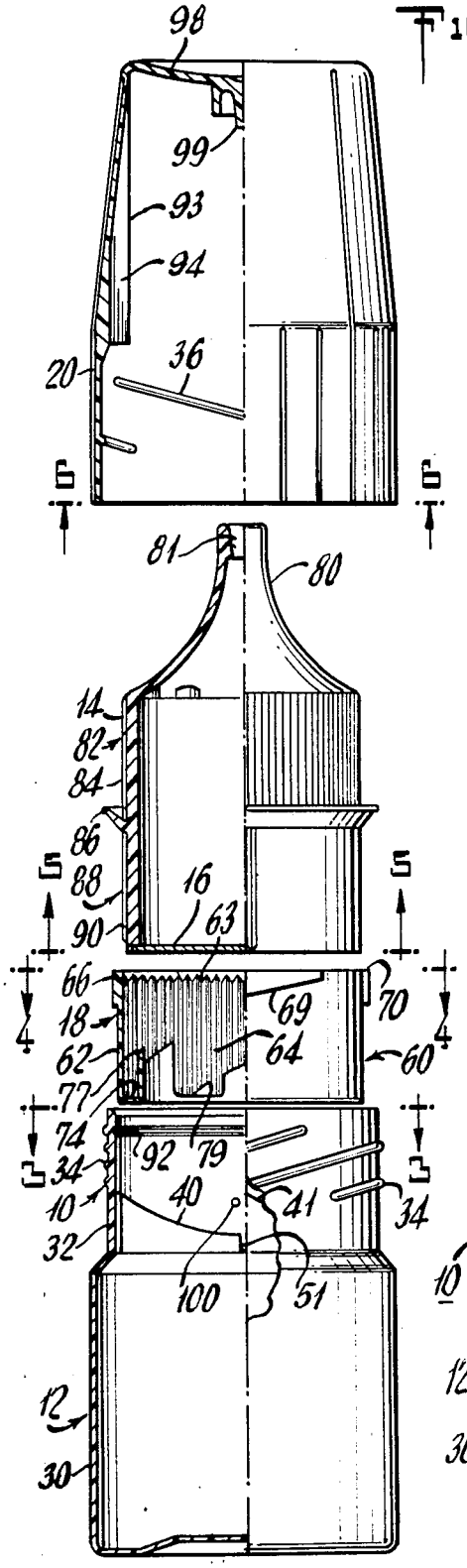
FIG. 1 is an exploded elevation view of a preferred embodiment of the invention, partly in cross-section.
Figure 2:
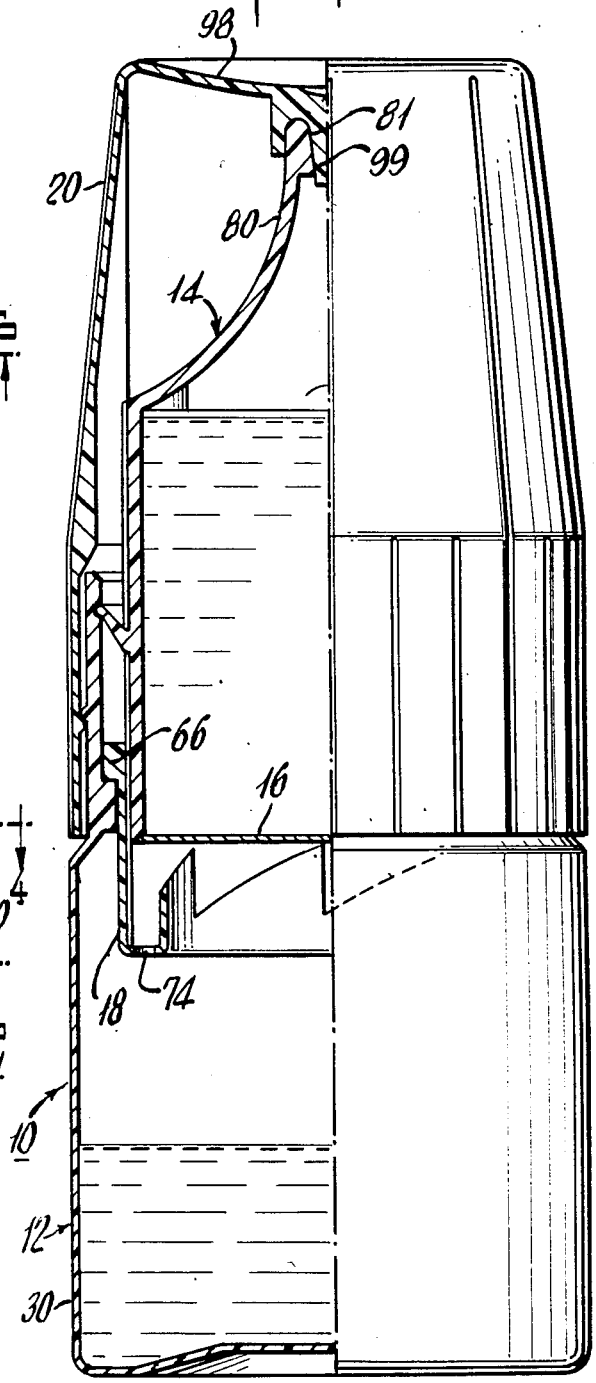
FIG. 2 is an elevation view of the parts of FIG. 1 assembled, partly in cross-section.

Referring now to FIG. 1, there is shown an axially exploded view of the various components of dual compartment container 10. Container 10 includes a bottom container 12, a top container 14, the open bottom end of which is sealed by a membrane 16, an annular knife member 18 interposed between the top and bottom containers and a cap member 20. The various components of FIG. 1, when assembled, appear as shown in FIG. 2.

Bottom container 12 includes a body portion 30 for containing a first fluid or other substance and a cylindrical neck portion 32 having a plurality of spiral threads 34 on the external surface thereof. Container 12 may be made of flexible material, for example, injection-molded low density polyethylene to facilitate dispensing of the contents during use. Threads 34 are designed for mateable engagement with multiple start threads 36 on the interior of cap member 20. As will be understood below, container body 30 may, if desired, be other than cylindrical since the only relative rotation required between various adjacent components occurs with respect to neck portion 32 which must be cylindrical.

Figure 3:
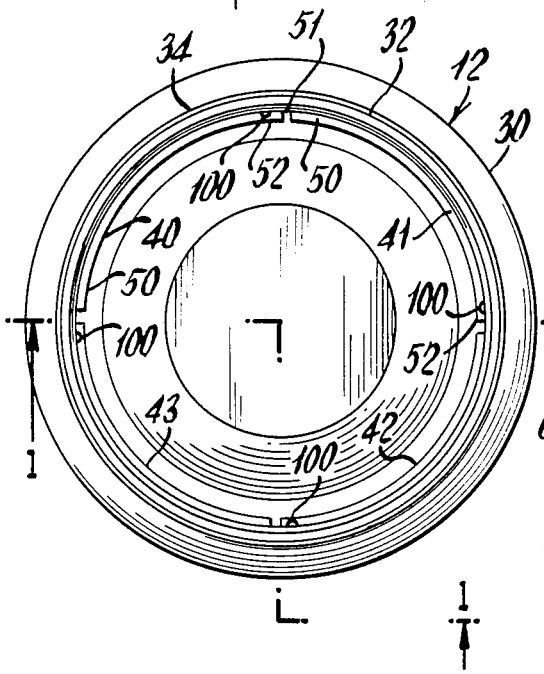
FIG. 3 is a cross-section of the lower container of the invention taken along the line 3—3 of FIG. 1.

The interior of neck portion 32 has four helical ramps 40, 41, 42 and 43 (best seen in FIG. 3) integrally molded therewith and extending radially inwardly. The leading edge 50 of each ramp abuts the trailing edge 52 of the adjacent ramp. If desired, a gap 51 may be created between adjacent ramps to assist drainage of fluid as will be better understood below.

Figure 4:
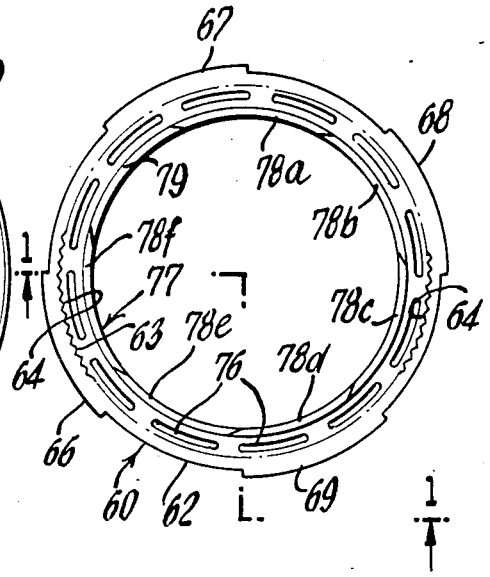
FIG. 4 is a cross-section of the knife member of the invention taken along the line 4—4 of FIG. 1.

Annular knife member 18 (made of a material such as polystyrene, for example, to maintain a cutting edge) has a cylindrical side wall 60 having an exterior surface 62 and an interior surface 63 provided with longitudinal splines 64 about its periphery. The outside diameter of surface 62 is slightly less than the inside diameter created by the most radially inward edges of ramps 40, 41, 42 and 43. The exterior surface 62 of knife member 18 has four cams 66, 67, 68 and 69 (best seen in FIGS. 1 and 4) integrally molded with side wall 60 adjacent the top annular edge 70 of knife member 18. Cams 66, 67, 68 and 69 extend radially outwardly from surface 62 a sufficient distance to overlap ramp surfaces 40, 41, 42 and 43.

Knife member 18 includes an inwardly extending annular ledge 74 transverse to the bottom edge of side wall 60. Annular ledge 74 has a plurality of drainage apertures 76 (best seen in FIG. 4) spaced about the periphery thereof. The inner most edge of annular ledge 74 is provided with substantially annular knife surface 77 which, in the preferred embodiment, comprises a plurality of upwardly extending knife edges 78*a*, 78*b*, 78*c*, 78*d*, 78*e* and 78*f* extending less than 360°. The cutting points of the knife edges are located on the most radially inward side of knife surface 77. In the preferred embodiment, knife surface 77 has a small, almost imperceptible inwardly extending taper such that the portion thereof distal to ledge 74 is more radially inward than the portion adjacent ledge 74. As will be understood below, the structure of knife surface 77 produces a cut in membrane 16 with a diameter small enough to drop through knife member 18. A gap 79 is provided so, as will be understood below, the sealing membrane is not totally cut. Each knife edge 78*a–f* may have a different height above ledge 74 so that only one knife edge will pierce sealing membrane 16 at any one time. The height variations concentrate the piercing force at one knife edge at any one time. The various heights of knife edges 78*a–f* are also staggered annularly. For example, in order of increasing height the knife edges may be arranged in the following way: 78*f*, 78*e*, 78*b*, 78*c*, 78*a*, 78*d*. Such an arrangement helps to prevent the knife member from tilting and binding during its longitudinal motion.

Figure 5:
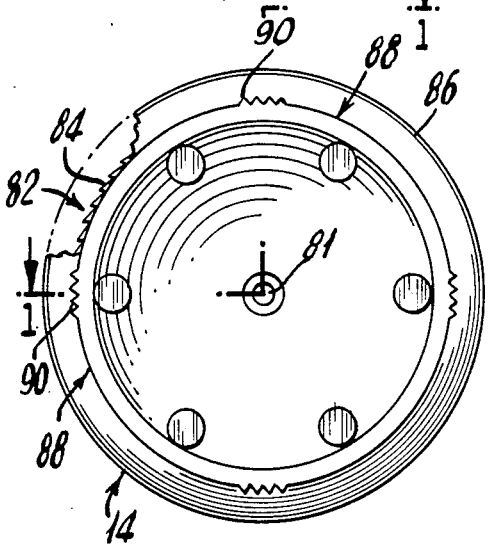
FIG. 5 is a cross-section of the upper container of the invention taken along the line 5—5 of FIG. 1.

Top container 14 includes a spout 80 having a central orifice 81, a top portion 82 provided with longitudinal ratchet teeth 84 about its periphery, a compression sealing bead 86 and a bottom portion 88 provided with longitudinal splines 90 about its periphery. In the preferred embodiment, to save on material requirements splines 90 are provided along discrete arcuate parts of portion 88, for example, at four locations spaced 90° apart as best seen in FIG. 5. Container 14 may be made of rigid polyvinyl chloride (PVC), for example, in order to be chemically compatible with the intended contents and to provide firm support for membrane 16 during piercing.

When the container 10 is assembled, it will be understood that knife member 18 fits into neck portion 32 so that cams 66, 67, 68 and 69 rest upon ramp members 40, 41, 42 and 43. It will be further understood that splines 90 of top container 14 will mesh with splines 64 on the internal surface of knife member 18. Sealing bead 86 is pressed into annular groove 92 in neck portion 32 in order to seal bottom container 12.

Figure 6:
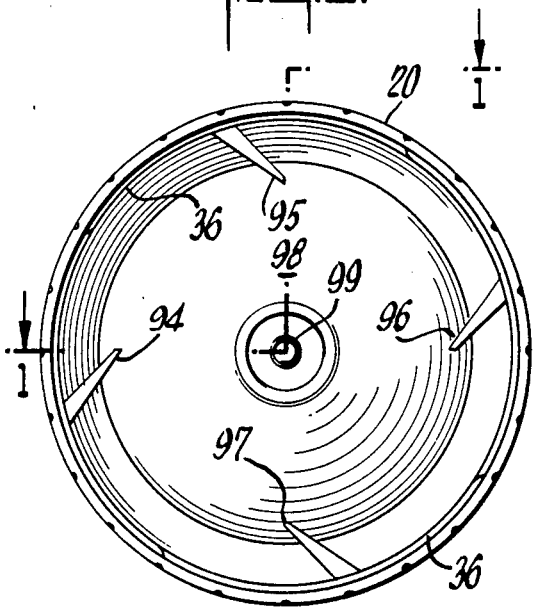
FIG. 6.is a cross-section of the cap of the invention taken along the line 6—6 of FIG. 1.

Cap member 20 (made of polypropylene, for example) is provided with four pawl members 94, 95, 96 and 97 (best seen in FIG. 6) radially inwardly extending from the upper portion of cap member 20. Each pawl member has a longitudinally aligned contact edge 93 at its most radially inward edge for engaging ratchet teeth 84. As best seen in FIGS. 5 and 6, the orientation of the pawl members and ratchet teeth 84 serves as a one-way ratchet to enable common rotation of cap member 20 and top container 14 only in one direction. Cap member 20 has pre-loaded concave top 98 and a center plug 99 for sealing the orifice of spout 80 while providing a pressure venting capability. In a preferred embodiment, cap member 20 has four multiple-start threads 36.

Membrane 16 is, in the preferred embodiment, a laminate of several films. For example, the inner layer in contact with the contents of container 14 may be PVC, the middle layer may be aluminum and the outer layer may be low density polyethylene. The requirements for the membrane are that it be chemically compatible with the container contents and sufficiently strong to remain sealed until being pierced and sufficiently rigid to enable it to be pierced. The membrane should also be sufficiently flexible to fall down under the weight of the contents of container 14 and bend about the hinge left by flat portion 79. An additional requirement is that the membrane be resistant to deterioration due to exposure of the laminated edge to the chemicals in the container. This resistance may be achieved by the membrane itself or by providing bottom portion 88 with an annular lip (not shown) intended to wrap around the perimeter of the membrane in conventional, heat sealing fashion.

Assembly of container 10 is straightforward. Bottom container 12 is filled with a desired liquid or gel and knife member 18 is fed into place within neck portion 32. Knife member 18 is pushed into place so its cams 66, 67, 68 and 69 slide to the trailing edge of ramp surfaces 40, 41, 42 and 43. A slight rotating action is imparted to knife member 18 during assembly to assure that the cams and ramps are properly seated at the lowermost point. Since knife member 18 would be free to move and would only be restrained by gravity and friction, a small radially inwardly extending locating bead 100 is molded into the interior of neck portion 32 above the trailing edge of each ramp to provide a slight interference to axial motion of the knife member. The distance of each bead 100 above its respective trailing edge 52 is slightly greater than the maximum height of cams 66, 67, 68 and 69 in order to provide a friction fit to hold knife member 18 during assembly and shipping. In the preferred embodiment, knife member 18 is, prior to use, approximately ⅛" below membrane 16. After knife member 18 is in place, top container 14, provided with sealing membrane 16, is inserted so that splines 90 mesh with splines 64 and so that sealing bead 86 is pressed into groove 92. Top container 14 may then be filled with a second liquid, gel or other substance. Cap member 20 is then threaded on to bottom container 12, sealing spout orifice 81 with plug 99 with the one-way ratchet assembly urging top container 14 clockwise so that cam members 66, 67, 68 and 69 will abut the leading edges of ramps 40, 41, 42 and 43 to further assure that knife member 14 does not ride up the ramps until container 10 is ready for use.

Figure 7A:
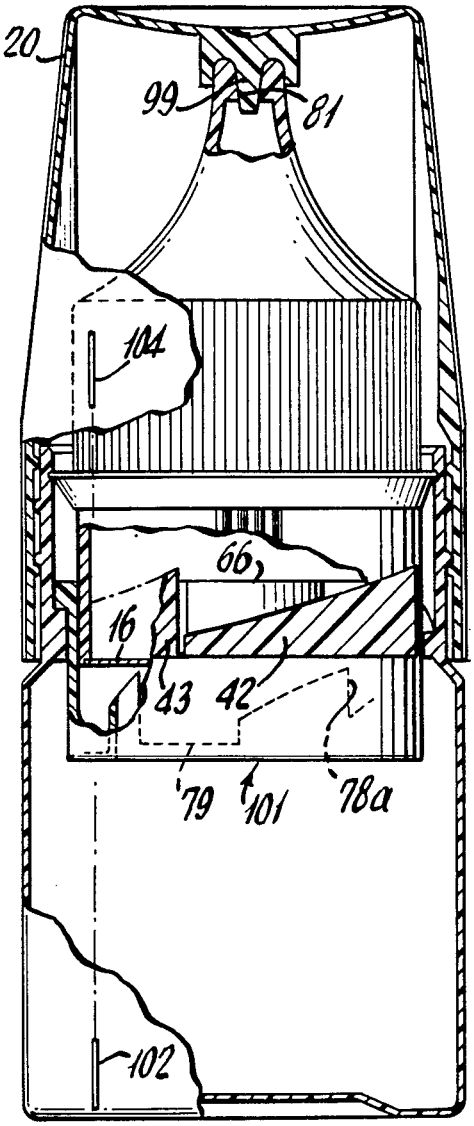
Figure 7B:
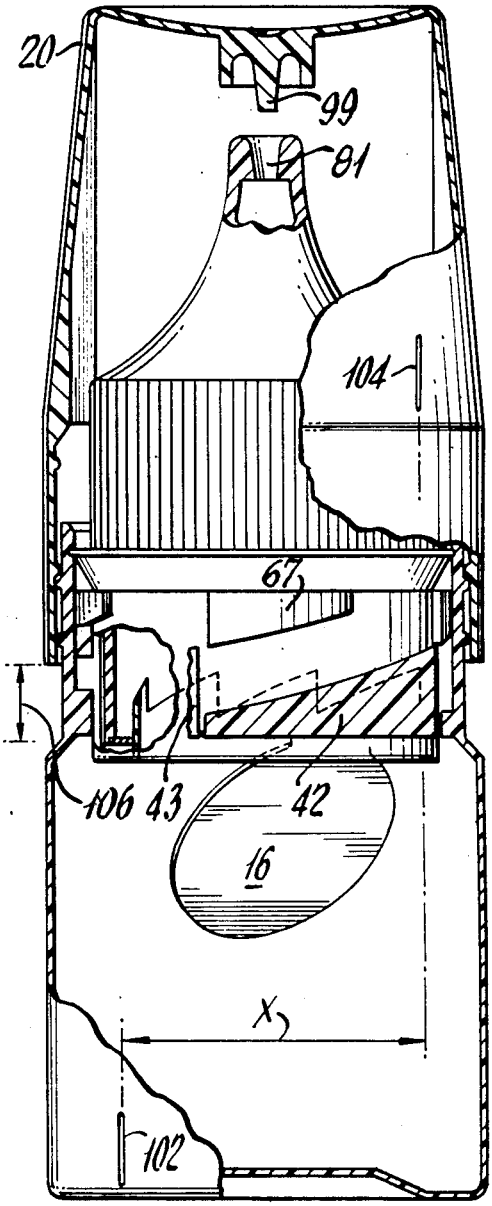

Referring now to FIG. 7*a* and 7*b*, the operation of dual compartment container 10 will be best understood. FIG. 7*a* shows the position of the assembled components prior to use and FIG. 7*b* shows the position of the components after cap member 20 is turned and membrane 16 is pierced. For explanatory purposes only, an index mark 102 is shown on bottom container 12 and an index mark 104 is shown on top container 14. Prior to use, knife member 18 is at its bottom-most point in position 101 with knife edges 78 just below membrane 16. To use container 10 a user need only rotate cap member 20 counterclockwise to disengage threads 34 and 36. This action simultaneously disengages cap member 20 from container 12, unplugs the spout orifice and raises knife member 18 a predetermined distance 106 sufficient to pierce membrane 16. As will be seen by reference to FIG. 7*b*, all these actions result from a simple rotation of cap member 20 relative to container 12 by an arcuate distance "X" sufficient to disengage the threads. In the preferred embodiment, this is about 100°. After the membrane has been cut, it remains secured about a hinge portion which is not cut because of gap 79 in the knife member.

The arrangement of cams, ramps and splines serves to enable longitudinal motion of knife member 18 relative to top container 14 while limiting relative rotary motion therebetween. Alternative arrangements are possible. For example, the longitudinal motion could also be achieved by providing a radially outwardly extending cam member or lug on knife member 18 and a corresponding arcuate cam track on the interior surface of neck portion 32. The limitation of relative rotary motion could be achieved by a radially inwardly extending cam lug on knife member 18 on a corresponding longitudinal cam track in the top container.

It will be understood by those skilled in the art that numerous improvements and modifications may be made to the preferred embodiment of the invention disclosed herein without departing from the spirit and scope thereof.

What is claimed is:

1. A dual-compartment container for containing a different substance in each compartment, and for isolating said substances until the container is ready for use, comprising:

a first container having a cylindrical, threaded neck portion;

a second container rotatably and sealingly secured within said neck portion, the bottom end of said second container sealed by a membrane;

a cap for threadably engaging said neck portion;

means interposed between said cap and said second container for enabling common rotation in a predetermined direction;

a substantially annular knife member interposed between said first and second containers for piercing said membrane upon rotation of said cap in said predetermined direction and consequent rotation of said second container relative to said first container;

means for translating rotary motion of said cap to longitudinal motion of said knife member relative to said second container.

2. A container according to claim 1 wherein said knife member further comprises a plurality of adjacent arcuate knife edges which together subtend less than 360° in order to leave uncut a predetermined hinge portion of said membrane after same is pierced.

3. A dual-compartment container according to claim 1 wherein said second container is provided with a spout and wherein the orifice of said spout is adapted to be sealed by a plug on said cap.

4. A dual-compartment container according to claim 1 wherein said translating means comprises:

a first set of longitudinal splines on said second container;

a second set of longitudinal splines on said knife member, said second set adapted to engage said first set;

ramp means secured to the interior of said neck portion;

cam means secured to said knife member for following said ramp means upon rotation of said second container relative to said first container.

5. A dual-compartment container accordinq to claim 1 wherein said translating means comprises:

means for permitting relative longitudinal motion between said second container and said knife member while limiting relative rotary motion therebetween;

a cam track in the interior of said neck portion;

a cam member secured to said knife member for following said cam track upon rotation of said second container relative to said first container.

6. A dual-compartment container for containing a different substance in each container, and for isolating said substances until the container is ready for use, comprising:

a first container for containing one of said substances, said first container having a cylindrical neck portion, said neck portion having a first thread means on the exterior surface thereof and a ramp means, on the interior surface thereof;

a second container for containing the other of said substances and being axially aligned with said first container, said second container having a cylindrical bottom end for fitting within said neck portion, a membrane for sealing said bottom end, and a spout;

an annular sealing means interposed between said first and second containers, said annular sealing means enabling relative rotation therebetween;

a cap for threadably engaging said first thread means and sealing said spout;

means for enabling common rotation of said cap and said second container for a predetermined arcuate distance during the disengagement of said cap from said first thread means;

a knife member comprising a plurality of axially aligned knife edges annularly arranged beneath said membrane, said knife member having a cam means for following said ramp means upon rotation of said second container relative to said first container and a means for limiting rotary motion of said knife member relative to said second container.

7. A container according to claims 2 or 6 wherein those of said knife edges subtending a predetermined arc on said knife member are of successively increasing heights.

8. A container according to claims 2 or 6 wherein said knife edges are tapered inwardly to enable the cut portion of said membrane to have a diameter smaller than the diameter of the base of said knife edges.

9. In a dual-compartment container containing a different substance in each compartment and for isolating said substances until the container is ready for use, said dual-compartment container comprising axially aligned first and second containers, said first container having a threaded neck portion and said second container having a spout, said first and second containers being relatively rotatable, means for sealing at least one of said first or second containers to isolate said substances, a knife member for cutting said sealing means, a cap threadably engaged with said first container, the improvement comprising:

means for enabling one of said substances to mix with the other of said substances by causing said knife member to cut said sealing means while said cap is threadably disengaged from said first container.

10. A method for mixing the contents of a dual-compartment container comprising first and second containers, said second container axially aligned within the neck portion of said first container and having a spout, said contents comprising a first substance contained in said first container and a second substance contained in said second container, said first and second substances isolated from each other by a membrane sealing member secured to at least one of said first or second containers, said dual-compartment container further comprising a knife member for cutting said sealing member and a cap threadably engaged with said first container, the method comprising:

threadably disengaging said cap to thereby simultaneously move said knife member axially in order to cut said sealing member;

permitting said first substance to mix with said second substance.

* * * * *